US006212912B1

(12) United States Patent
Sangiacomo

(10) Patent No.: US 6,212,912 B1
(45) Date of Patent: Apr. 10, 2001

(54) METHOD FOR THE MANUFACTURE OF DESIGNED KNITWEAR ON CIRCULAR STOCKING KNITTING AND KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/607,443

(22) Filed: Jun. 30, 2000

(30) Foreign Application Priority Data

Jul. 20, 1999 (IT) ..... BS99A0072

(51) Int. Cl.[7] ..... D04B 9/28
(52) U.S. Cl. ..... 66/40; 66/180
(58) Field of Search ..... 66/8, 13, 17, 38, 66/40, 42 R, 215, 178 R, 180, 181, 201

(56) References Cited

U.S. PATENT DOCUMENTS 2,402,744 * 6/1946 Fregeolle ..... 66/180
4,034,581 * 7/1977 Swafford ..... 66/180
4,633,683 * 1/1987 Schmidt ..... 66/9 R

* cited by examiner

*Primary Examiner*—Danny Worrell
(74) *Attorney, Agent, or Firm*—McGlew and Tuttle, P.C.

(57) ABSTRACT

A method and circular stocking knitting and knitting machine are disclosed. The method includes providing a first base yarn and a second base yarn for the manufacture of a basic knit fabric and a dyed yarn of a design, providing only one control for selecting the needles of the design at each feeding station of the machine and selecting the needles which must form the design such that each of the selected needles picks up and knits the dyed yarn of the design and the second base yarn dropping or discarding the first base yarn, while the remaining unselected needles pick up and knit the base yarns, discarding the dyed yarn of the design. The circular stocking knitting and knitting machine includes a selecting and controlling device for controlling selected needles of the design in order to raise these selected needles to a level higher than the remaining needles.

4 Claims, 2 Drawing Sheets

METHOD FOR THE MANUFACTURE OF DESIGNED KNITWEAR ON CIRCULAR STOCKING KNITTING AND KNITTING MACHINES

FIELD OF THE INVENTION

The present invention pertains to the field of circular stocking knitting and knitting machines and specifically pertains to a method for the manufacture of designed knitwear on such machines.

BACKGROUND OF THE INVENTION

Various methods for the manufacture of designed knitwear on circular stocking knitting and knitting machines have already become known. One method, for example, consists of knitting with the needles of the machine at least one base thread with, alternately, two natural yarns or two yarns of different color and with a dual selection of the needles that must form the design of the knitwear. Another method consists of knitting, in the missed stitch form, at least one base yarn with another yarn of a different color or type by means of a single selection of the needles, which must form the design. However, the design that will thus be created in the knitted article has never been defined well and clearly, with the yarn of a different color or type being mixed together with the base yarn.

SUMMARY AND OBJECTS OF THE INVENTION

Thus, the object of the present invention is to provide a novel method for the manufacture of designed knitwear with only one selection of the needles, starting from a first base yarn (coarser), a second base yarn (or weft, finer than the first one) and a dyed yarn for the design. This method provides for knitting the dyed yarn together with the second base yarn, discarding the first base yarn in such a manner that the design becomes better defined, clearer and has a solid color. The object is accomplished by selecting the needles that must form the design of the knitwear in such a way that each of them picks up and knits the dyed yarn and the second base yarn, dropping, or discarding, the first base yarn, while the remaining needles pick up and knit both of the base yarns, excluding the dyed yarn of the design.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
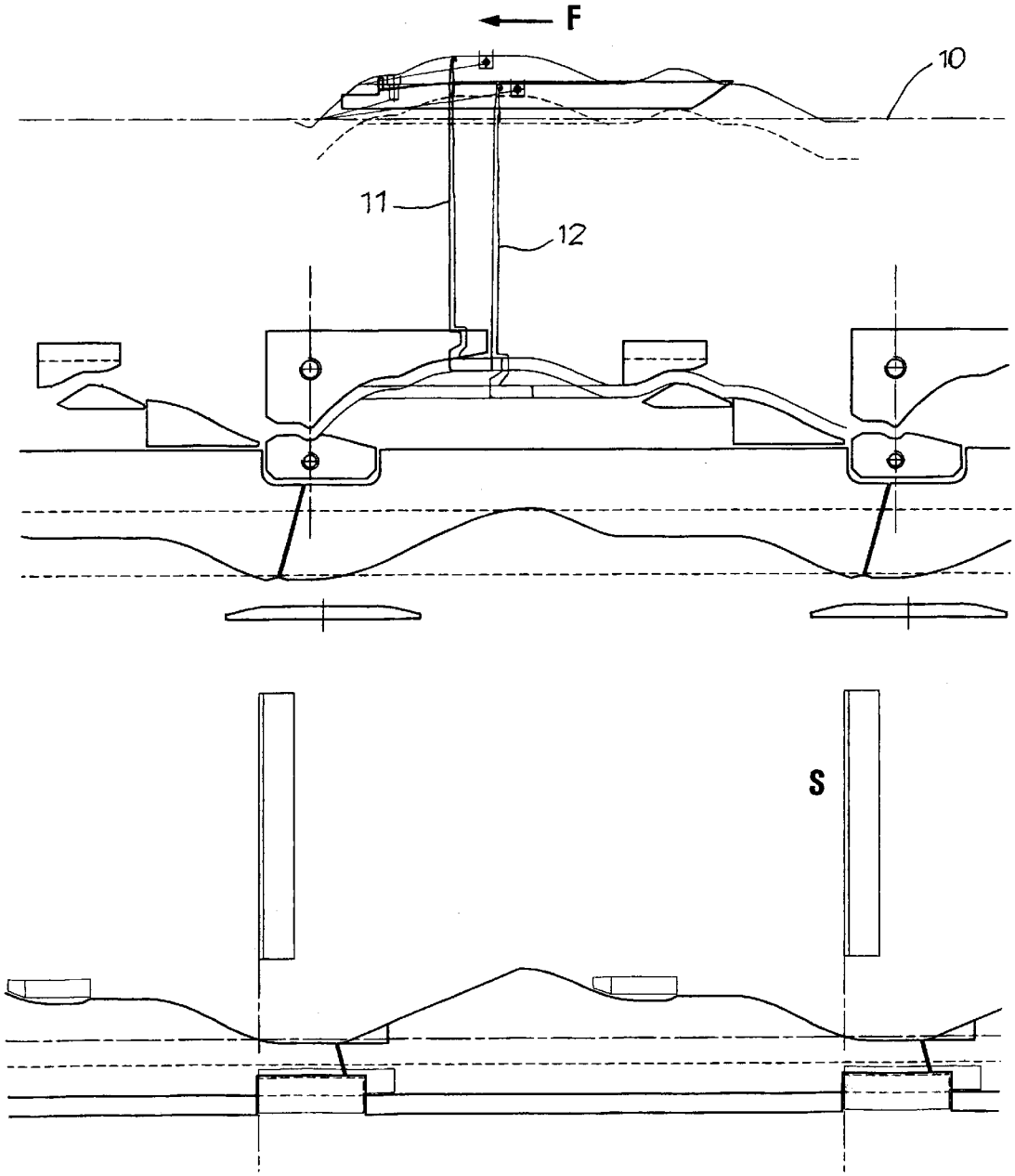
FIG. 1 is a view, in developed form, showing parts of the cams for controlling the needles in a circular stocking knitting machine.

Referring to the drawings in particular, 10 denotes the plane of the sinkers of a circular stocking machine, 11 denotes one of the needles selected and intended to form the design of the manufactured knit article, 12 denotes one of the needles that usually knit as not selected, 13 denotes a first base yam, which is fed with a respective yam guide 13", 14 denotes a second base yam coming from a respective yam guide 14', and 15 denotes a dyed yam for the design. The dyed yam 15 is fed by a respective yam guide 15'. The yam guide 15' is arranged at a level higher than the base yams corresponding to each feeding station of the needles.

FIG. 1 of the drawings also shows the cams for the ascending and descending operating movements of the needles selected and not selected and the arrow F denotes the direction of rotation of the needles in relation to the cams.

Figure 2:
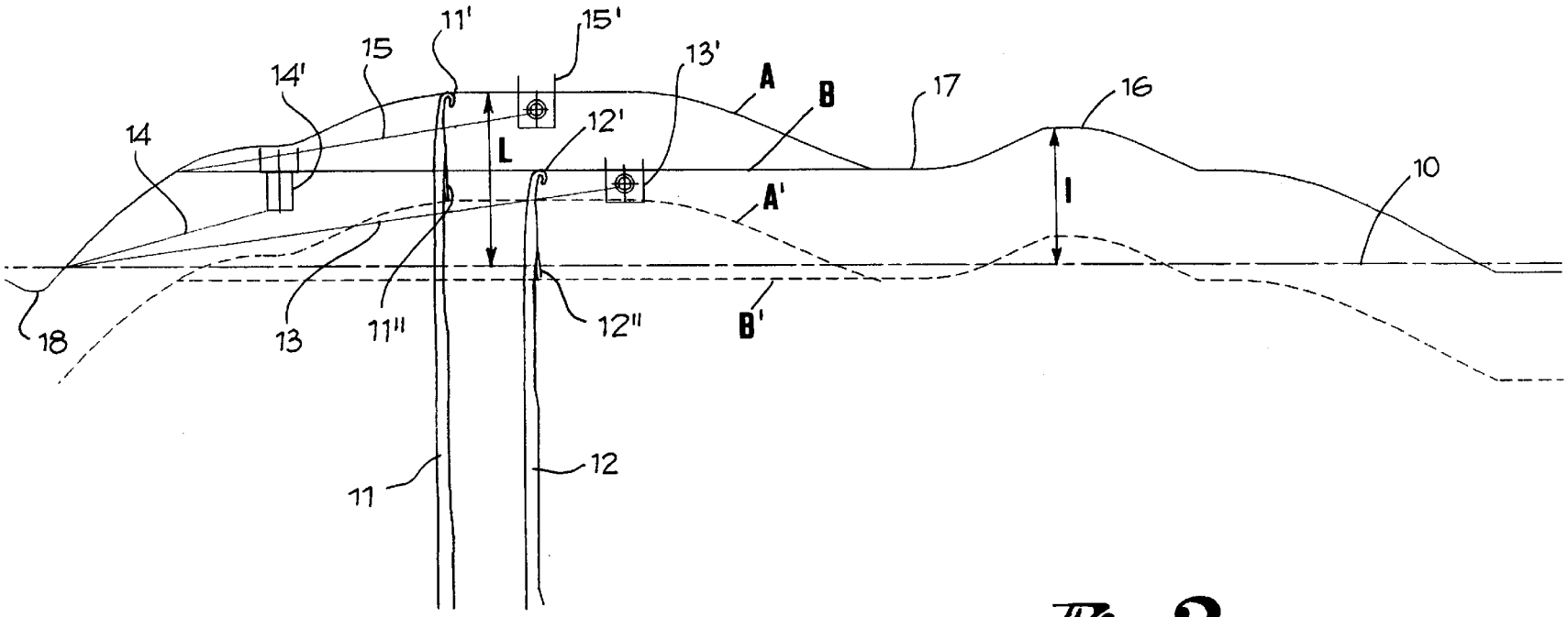
FIG. 2 is a diagram, which is indicative of the course of the needles for manufacturing the designed knitwear according to the present invention.

In particular, in FIG. 2, 16 denotes an empty zone of stitches previously made by all of the needles selected and not selected. In this zone 16, the needles are all equally raised to a level l on the plane of the sinkers 10 and their blade is open and rotated, i.e., downwards against the shank of the needle for the opening of the hook of the needle. Such an empty zone 16 is followed by a zone 17 of partial lowering of the needles, from which the needles selected 11 then follow a different course than the unselected needles 12.

A first solid line A and a first dotted line A', which are parallel to one another, indicate the course of the hook 11' and of the end of the blade 11", respectively, of the needles selected 11'. A second solid line B and a second dotted line B', which are parallel to one another, are, in their turn, indicative of the course of the hook 12' and of the blade 12", respectively, of the needles which are not selected. Of the different course A, A'; B, B', the first ones are a level higher than the second ones and come from the zone 17, which follows the empty zone 16, to the usual pulling-down zone 18, which is downstream from the station for the feeding of the base yams and of the design. From the zone 18, all of the needles then follow a common course up to the next empty zone 16. The needles of the design are, therefore, selected corresponding to a single zone S of the course of the needles (FIG. 1).

Having stated all this, to carry out the method according to the present invention, each of the needles 11 selected in S is controlled and raised to follow, with its own hook 11', the course A until it reaches the level L above the plane of the sinkers 10, which is higher than the empty level l, and, at any rate, a level higher than that reached by the hook of the unselected needles 12, which usually follow the course B. More precisely, the height L reached by the book of the selected needles 11 is fixed beforehand in such a way that said hook is able to pick up the dyed thread of the design 15 (cf. FIG. 2), which is positioned at a level for feeding the said needles. On the other hand, the open blade 11" of each needle selected 11 follows the course A' to a level such as to pass above the first base yarn 13 coming from the yard guide 13' and such that this yarn 13 is arranged behind the blade proper.

Therefore, the needles selected 11, when they are subsequently lowered towards the stitch-pulling-down zone 18, pick up and knit the dyed yarn of the design 15, and then the second base yarn 14, while they are not able to pick up the first base yarn 13. This first base yarn 13 is thus excluded from the knitting by the needles selected 11. Actually, the blades of said needles 11 will be closed by said first base yarn, which thus cannot be picked up by the hooks of the needles proper.

On the other hand, the needles that are not selected, following the course B with their hook 12' and B' with their blade 12", usually pick up the first base yarn 13 and the second base yarn 14, while they do not arrive at the level of the dyed yarn of the design, thus failing to pick up same.

The design of the knit article is thus obtained by picking up and knitting only the dyed yarn with the result as stated above of a clearer and more solid design.

While specific embodiments of the invention have been shown and described in detail to illustrate the application of the principles of the invention, it will be understood that the invention may be embodied otherwise without departing from such principles.

What is claimed is:

1. A method for the manufacture of designed knitwear on circular stocking knitting and knitting machines, the method comprising the steps of:

providing a first base yarn and a second base yarn for the manufacture of a basic knit fabric and a dyed yarn of a design;

providing only one control for selecting the needles of the design at each feeding station of the machine;

selecting the needles which must form the design such that each of the selected needles picks up and knits the dyed yarn of the design and the second base yarn dropping or discarding the first base yarn, while the remaining unselected needles pick up and knit the base yarns, discarding the dyed yarn of the design.

2. A method for the manufacture of designed knitwear in accordance with claim 1, further comprising the steps of:

feeding the dyed yarn of the design at a level higher than the base yarns;

guiding each needle selected to a the level for picking up the dyed yarn of the design;

raising the unselected needles to a level lower than that reached by the selected needles so that the unselected needles pick up the base yarns; and lowering all selected and unselected needles to a level for pulling down stitches.

3. A method for manufacturing designed knitwear in accordance with claim 2, wherein each selected needle, when it is raised to a level for picking up the dyed yarn of the design, is positioned with its hook above the dyed yarn and with the end of its open blade above the first base yarn, the base yam being arranged behind the blade, while each needle that is not selected reaches, with its hook, a level that is lower than the position of the dyed yarn of the design.

4. A circular stocking knitting and knitting machine carrying out a method including providing a first base yarn and a second base yam for the manufacture of a basic knit fabric and a dyed yam of a design, providing only one control for selecting the needles of the design at each feeding station of the machine and selecting the needles which must form the design such to that each of the selected needles picks up and knits the dyed yarn of the design and the second base yam dropping or discarding the first base yam, while the remaining unselected needles pick up and knit the base yarns, discarding the dyed yarn of the design, the circular stocking knitting and knitting machine comprising:

a device for selecting and controlling selected needles of the design in order to raise these selected needles to a level higher than the remaining needles.

* * * * *